US007083005B2

(12) United States Patent
Galloway et al.

(10) Patent No.: US 7,083,005 B2
(45) **Date of Patent: *Aug. 1, 2006**

(54) APPARATUS AND METHOD OF DRILLING WITH CASING

(75) Inventors: Gregory G. Galloway, Conroe, TX (US); David J. Brunnert, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/140,858

(22) Filed: May 31, 2005

(65) Prior Publication Data

US 2005/0217858 A1 Oct. 6, 2005

Related U.S. Application Data

(63) Continuation of application No. 10/319,792, filed on Dec. 13, 2002, now Pat. No. 6,899,186.

(51) Int. Cl.
*E21B 7/08* (2006.01)

(52) U.S. Cl. ..... 175/5; 175/7; 175/171; 166/358

(58) Field of Classification Search ..... 175/171, 175/5, 7, 8; 166/358, 242.7
See application file for complete search history.

(56) References Cited

U.S. PATENT DOCUMENTS

| | | | |
|---|---|---|---|
| 122,514 | A | 1/1872 | Bullock |
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,418,766 | A | 6/1922 | Wilson |
| 1,471,526 | A | 10/1923 | Pickin |
| 1,585,069 | A | 5/1926 | Youle |
| 1,728,136 | A | 9/1929 | Power |
| 1,777,592 | A | 10/1930 | Thomas |
| 1,825,026 | A | 9/1931 | Thomas |
| 1,830,625 | A | 11/1931 | Schrock |
| 1,842,638 | A | 1/1932 | Wigle |

(Continued)

FOREIGN PATENT DOCUMENTS

| | | |
|---|---|---|
| CA | 2 335 192 | 11/2001 |

(Continued)

OTHER PUBLICATIONS

Alexander Sas-Jaworsky and J. G. Williams, Development of Composite Coiled Tubing For Oilfield Services, SPE 26536, Society of Petroleum Engineers, Inc., 1993.

(Continued)

*Primary Examiner*—William Neuder
(74) *Attorney, Agent, or Firm*—Patterson & Sheridan, L.L.P.

(57) ABSTRACT

The present invention generally relates to methods for drilling a subsea wellbore and landing a casing mandrel in a subsea wellhead. In one aspect, a method of drilling a subsea wellbore with casing is provided. The method includes placing a string of casing with a drill bit at the lower end thereof in a riser system and urging the string of casing axially downward. The method further includes reducing the axial length of the string of casing to land a wellbore component in a subsea wellhead. In this manner, the wellbore is formed and lined with the string of casing in a single run. In another aspect, a method of forming and lining a subsea wellbore is provided. In yet another aspect, a method of landing a casing mandrel in a casing hanger disposed in a subsea wellhead is provided.

36 Claims, 7 Drawing Sheets

U.S. PATENT DOCUMENTS

| | | | |
|---|---|---|---|
| 1,880,218 | A | 10/1932 | Simmons |
| 1,917,135 | A | 7/1933 | Littell |
| 1,981,525 | A | 11/1934 | Price |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,105,885 | A | 1/1938 | Hinderliter |
| 2,167,338 | A | 7/1939 | Murcell |
| 2,214,429 | A | 9/1940 | Miller |
| 2,216,895 | A | 10/1940 | Stokes |
| 2,228,503 | A | 1/1941 | Boyd et al. |
| 2,295,803 | A | 9/1942 | O'Leary |
| 2,305,062 | A | 12/1942 | Church et al. |
| 2,324,679 | A | 7/1943 | Cox |
| 2,370,832 | A | 3/1945 | Baker |
| 2,379,800 | A | 7/1945 | Hare |
| 2,414,719 | A | 1/1947 | Cloud |
| 2,499,630 | A | 3/1950 | Clark |
| 2,522,444 | A | 9/1950 | Grable |
| 2,536,458 | A | 1/1951 | Munsinger |
| 2,610,690 | A | 9/1952 | Beatty |
| 2,621,742 | A | 12/1952 | Brown |
| 2,627,891 | A | 2/1953 | Clark |
| 2,641,444 | A | 6/1953 | Moon |
| 2,650,314 | A | 8/1953 | Hennigh, et al. |
| 2,663,073 | A | 12/1953 | Bieber et al. |
| 2,668,689 | A | 2/1954 | Cormany |
| 2,692,059 | A | 10/1954 | Bolling, Jr. |
| 2,720,267 | A | 10/1955 | Brown |
| 2,738,011 | A | 3/1956 | Mabry |
| 2,743,087 | A | 4/1956 | Layne et al. |
| 2,743,495 | A | 5/1956 | Eklund |
| 2,741,907 | A | 6/1956 | Genender et al. |
| 2,764,329 | A | 9/1956 | Hampton |
| 2,765,146 | A | 10/1956 | Williams |
| 2,805,043 | A | 9/1957 | Williams |
| 2,953,406 | A | 9/1960 | Young |
| 2,978,047 | A | 4/1961 | DeVaan |
| 3,006,415 | A | 10/1961 | Burns et al. |
| 3,036,530 | A | 5/1962 | Mills et al. |
| 3,041,901 | A | 7/1962 | Knights |
| 3,054,100 | A | 9/1962 | Jones |
| 3,087,546 | A | 4/1963 | Wooley |
| 3,090,031 | A | 5/1963 | Lord |
| 3,102,599 | A | 9/1963 | Hillburn |
| 3,111,179 | A | 11/1963 | Albers et al. |
| 3,117,636 | A | 1/1964 | Wilcox et al. |
| 3,122,811 | A | 3/1964 | Gilreath |
| 3,123,160 | A | 3/1964 | Kammerer |
| 3,124,023 | A | 3/1964 | Marquis et al. |
| 3,131,769 | A | 5/1964 | Rochemont |
| 3,159,219 | A | 12/1964 | Scott |
| 3,169,592 | A | 2/1965 | Kammerer |
| 3,191,677 | A | 6/1965 | Kinley |
| 3,191,680 | A | 6/1965 | Vincent |
| 3,193,116 | A | 7/1965 | Kenneday et al. |
| 3,353,599 | A | 11/1967 | Swift |
| 3,380,528 | A | 4/1968 | Timmons |
| 3,387,893 | A | 6/1968 | Hoever |
| 3,392,609 | A | 7/1968 | Bartos |
| 3,419,079 | A | 12/1968 | Current |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,550,684 | A | 12/1970 | Cubberly, Jr. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,552,848 | A | 1/1971 | Van Wagner |
| 3,559,739 | A | 2/1971 | Hutchison |
| 3,566,505 | A | 3/1971 | Martin |
| 3,570,598 | A | 3/1971 | Johnson |
| 3,575,245 | A | 4/1971 | Cordary et al. |
| 3,602,302 | A | 8/1971 | Kluth |
| 3,603,411 | A | 9/1971 | Link |
| 3,603,412 | A | 9/1971 | Kammerer, Jr. et al. |
| 3,603,413 | A | 9/1971 | Grill et al. |
| 3,606,664 | A | 9/1971 | Weiner |
| 3,624,760 | A | 11/1971 | Bodine |
| 3,635,105 | A | 1/1972 | Dickmann et al. |
| 3,656,564 | A | 4/1972 | Brown |
| 3,662,842 | A | 5/1972 | Bromell |
| 3,669,190 | A | 6/1972 | Sizer et al. |
| 3,680,412 | A | 8/1972 | Mayer et al. |
| 3,691,624 | A | 9/1972 | Kinley |
| 3,691,825 | A | 9/1972 | Dyer |
| 3,692,126 | A | 9/1972 | Rushing et al. |
| 3,696,332 | A | 10/1972 | Dickson, Jr. et al. |
| 3,700,048 | A | 10/1972 | Desmoulins |
| 3,729,057 | A | 4/1973 | Werner |
| 3,746,330 | A | 7/1973 | Taciuk |
| 3,747,675 | A | 7/1973 | Brown |
| 3,760,894 | A | 9/1973 | Pitifer |
| 3,766,991 | A | 10/1973 | Brown |
| 3,776,320 | A | 12/1973 | Brown |
| 3,785,193 | A | 1/1974 | Kinley et al. |
| 3,808,916 | A | 5/1974 | Porter et al. |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,870,114 | A | 3/1975 | Pulk et al. |
| 3,881,375 | A | 5/1975 | Kelly |
| 3,885,679 | A | 5/1975 | Swoboda, Jr. et al. |
| 3,901,331 | A | 8/1975 | Djurovic |
| 3,913,687 | A | 10/1975 | Gyongyosi et al. |
| 3,915,244 | A | 10/1975 | Brown |
| 3,933,108 | A | 1/1976 | Baugh |
| 3,934,660 | A | 1/1976 | Nelson |
| 3,945,444 | A | 3/1976 | Knudson |
| 3,947,009 | A | 3/1976 | Nelmark |
| 3,964,556 | A | 6/1976 | Gearhart et al. |
| 3,980,143 | A | 9/1976 | Swartz et al. |
| 4,006,777 | A | 2/1977 | LaBauve |
| 4,009,561 | A | 3/1977 | Young |
| 4,049,066 | A | 9/1977 | Richey |
| 4,054,332 | A | 10/1977 | Bryan, Jr. |
| 4,054,426 | A | 10/1977 | White |
| 4,063,602 | A | 12/1977 | Howell et al. |
| 4,064,939 | A | 12/1977 | Marquis |
| 4,077,525 | A | 3/1978 | Callegari et al. |
| 4,082,144 | A | 4/1978 | Marquis |
| 4,083,405 | A | 4/1978 | Shirley |
| 4,085,808 | A | 4/1978 | Kling |
| 4,095,865 | A | 6/1978 | Denison et al. |
| 4,100,968 | A | 7/1978 | Delano |
| 4,100,981 | A | 7/1978 | Chaffin |
| 4,113,236 | A | 9/1978 | Neinast |
| 4,116,274 | A | 9/1978 | Rankin et al. |
| 4,127,927 | A | 12/1978 | Hauk et al. |
| 4,133,396 | A | 1/1979 | Tschirky |
| 4,142,739 | A | 3/1979 | Billingsley |
| 4,144,396 | A | 3/1979 | Okano et al. |
| 4,173,457 | A | 11/1979 | Smith |
| 4,175,619 | A | 11/1979 | Davis |
| 4,186,628 | A | 2/1980 | Bonnice |
| 4,189,185 | A | 2/1980 | Kammerer, Jr. et al. |
| 4,194,383 | A | 3/1980 | Huzyak |
| 4,221,269 | A | 9/1980 | Hudson |
| 4,227,197 | A | 10/1980 | Nimmo et al. |
| 4,241,878 | A | 12/1980 | Underwood |

4,256,146 A 3/1981 Genini et al.
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,291,772 A 9/1981 Beynet
4,396,077 A 9/1981 Radtke
4,311,195 A 1/1982 Mullins, II
4,315,553 A 2/1982 Stallings
4,320,915 A 3/1982 Abbott et al.
4,336,415 A 6/1982 Walling
4,384,627 A 5/1983 Ramirez-Jauregui
4,392,534 A 7/1983 Miida
4,396,076 A 8/1983 Inoue
4,407,378 A 10/1983 Thomas
4,408,669 A 10/1983 Wiredal
4,413,682 A 11/1983 Callihan et al.
4,427,063 A 1/1984 Skinner
4,430,892 A 2/1984 Owings
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,534,426 A 8/1985 Hooper
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,840,128 A 6/1989 McFarlane et al.
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,883,125 A 11/1989 Wilson et al.
4,962,822 A 1/1990 Pascale
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger et al.
5,074,366 A 12/1991 Karlsson et al.
5,082,069 A 1/1992 Seiler et al.
5,085,273 A 2/1992 Coone
5,096,465 A 3/1992 Chen et al.
5,613,567 A 3/1992 Hudson
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski 5,172,765 A 12/1992 Sas-Jaworsky et al.
5,176,180 A 1/1993 Williams et al.
5,176,518 A 1/1993 Hordijk et al.
5,181,571 A 1/1993 Mueller et al.
5,186,265 A 2/1993 Henson et al.
5,191,932 A 3/1993 Seefried et al.
5,191,939 A 3/1993 Stokley
5,197,553 A 3/1993 Leturno
5,209,302 A 5/1993 Robichaux et al.
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,339,899 A 8/1994 Ravi et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,398,760 A 3/1995 George et al.
5,402,856 A 4/1995 Warren et al.
5,412,568 A 5/1995 Schultz
5,433,279 A 7/1995 Tessari et al.
5,435,400 A 7/1995 Smith
5,452,923 A 9/1995 Smith
5,458,209 A 10/1995 Hayes et al.
5,461,905 A 10/1995 Penisson
5,546,317 A 10/1995 Hood, III et al.
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle
5,547,029 A 8/1996 Rubbo et al.
5,547,314 A 8/1996 Ames
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,769,160 A 6/1998 Owens
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,804,713 A 9/1998 Kluth
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock 5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,003,607 A 12/1999 Hagen et al.
6,012,529 A 1/2000 Mikolajczyk et al.
6,024,169 A 2/2000 Haugen
6,026,911 A 2/2000 Angle et al.
6,035,953 A 3/2000 Rear
6,039,118 A 3/2000 Carter et al.
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,670 A 6/2000 Carter et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,142,545 A 11/2000 Penman et al.
6,148,664 A 11/2000 Baird
6,148,922 A 11/2000 Vatne
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,192,980 B1 2/2001 Tubel et al.
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,224,112 B1 5/2001 Eriksen et al.
6,225,719 B1 5/2001 Hallundbaek
6,227,587 B1 5/2001 Terral
6,234,257 B1 5/2001 Ciglenec et al.
6,237,684 B1 5/2001 Bouligny, Jr. et al.
6,257,332 B1 7/2001 Vidrine et al.
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,343,649 B1 2/2002 Beck et al.
6,347,674 B1 2/2002 Bloom et al.
6,349,764 B1 2/2002 Adams et al.
6,354,373 B1 3/2002 Vercaemer et al.
6,357,485 B1 3/2002 Quigley et al.
6,359,569 B1 3/2002 Beck et al.
6,360,633 B1 3/2002 Pietras
6,367,552 B1 4/2002 Scott et al.
6,367,566 B1 4/2002 Hill
6,371,203 B1 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore et al.
6,390,190 B1 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,446,723 B1 9/2002 Ramons et al.
6,457,532 B1 10/2002 Simpson
6,458,471 B1 10/2002 Lovato et al.
6,464,004 B1 10/2002 Crawford et al.
6,464,011 B1 10/2002 Tubel
6,484,818 B1 11/2002 Alft et al.
6,497,280 B1 12/2002 Beck et al.
6,509,301 B1 1/2003 Vollmer
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B1 3/2003 Birkhead et al.
6,536,993 B1 3/2003 Strong et al.
6,538,576 B1 3/2003 Schultz et al.
6,540,025 B1 4/2003 Scott et al.
6,543,538 B1 4/2003 Tolman et al.
6,543,552 B1 4/2003 Metcalfe et al.
6,547,017 B1 4/2003 Vail, III
6,553,825 B1 4/2003 Boyd
6,554,064 B1 4/2003 Restarick et al.
6,585,040 B1 7/2003 Hanton et al.
6,591,471 B1 7/2003 Hollingsworth et al.
6,595,288 B1 7/2003 Mosing et al.
6,619,402 B1 9/2003 Amory et al.
6,622,796 B1 9/2003 Pietras
6,634,430 B1 10/2003 Dawson et al.
6,637,526 B1 10/2003 Juhasz et al.
6,648,075 B1 11/2003 Badrak et al.
6,651,737 B1 11/2003 Bouligny et al.
6,655,460 B1 12/2003 Bailey et al.
6,666,274 B1 12/2003 Hughes
6,668,684 B1 12/2003 Allen et al.
6,668,937 B1 12/2003 Murray
6,679,333 B1 1/2004 York et al.
6,688,394 B1 2/2004 Ayling
6,688,398 B1 2/2004 Pietras
6,691,801 B1 2/2004 Juhasz et al.
6,698,595 B1 3/2004 Norell et al.
6,702,040 B1 3/2004 Sensenig
6,708,769 B1 3/2004 Haugen et al.
6,715,430 B1 4/2004 Choi et al.
6,719,071 B1 4/2004 Moyes
6,725,924 B1 4/2004 Davidson et al.
6,725,938 B1 4/2004 Pietras
6,732,822 B1 5/2004 Slack et al.

| | | | | |
|---|---|---|---|---|
| 6,742,584 | B1 | 6/2004 | Appleton | |
| 6,742,596 | B1 | 6/2004 | Haugen | |
| 6,742,606 | B1 | 6/2004 | Metcalfe et al. | |
| 6,745,834 | B1 | 6/2004 | Davis et al. | |
| 6,752,211 | B1 | 6/2004 | Dewey et al. | |
| 6,776,233 | B1 | 8/2004 | Meehan | |
| 6,832,656 | B1 | 12/2004 | Fournier, Jr. et al. | |
| 6,832,658 | B1 | 12/2004 | Keast | |
| 6,837,313 | B1 | 1/2005 | Hosie et al. | |
| 6,840,322 | B1 | 1/2005 | Haynes | |
| 6,845,820 | B1 | 1/2005 | Herbert et al. | |
| 6,848,517 | B1 | 2/2005 | Wardley | |
| 6,854,533 | B1 | 2/2005 | Galloway et al. | |
| 6,857,486 | B1 | 2/2005 | Chitwood et al. | |
| 6,857,487 | B1 | 2/2005 | Galloway | |
| 6,868,906 | B1 | 3/2005 | Vail, III et al. | |
| 6,877,553 | B1 | 4/2005 | Cameron | |
| 6,892,835 | B1 | 5/2005 | Shahin et al. | |
| 6,896,075 | B1 | 5/2005 | Haugen et al. | |
| 6,899,186 | B1 * | 5/2005 | Galloway et al. | 175/5 |
| 6,899,772 | B1 | 5/2005 | Buytaert et al. | |
| 2001/0042625 | A1 | 11/2001 | Appleton | |
| 2002/0040787 | A1 | 4/2002 | Cook et al. | |
| 2002/0066556 | A1 | 6/2002 | Goode et al. | |
| 2002/0108748 | A1 | 8/2002 | Keyes | |
| 2002/0170720 | A1 | 11/2002 | Haugen | |
| 2002/0189863 | A1 | 12/2002 | Wardley | |
| 2003/0029641 | A1 | 2/2003 | Meehan | |
| 2003/0056991 | A1 | 3/2003 | Hahn et al. | |
| 2003/0070841 | A1 | 4/2003 | Merecka et al. | |
| 2003/0111267 | A1 | 6/2003 | Pia | |
| 2003/0141111 | A1 | 7/2003 | Pia | |
| 2003/0146023 | A1 | 8/2003 | Pia | |
| 2003/0164251 | A1 | 9/2003 | Tulloch | |
| 2003/0164276 | A1 | 9/2003 | Snider et al. | |
| 2003/0173073 | A1 | 9/2003 | Snider et al. | |
| 2003/0173090 | A1 | 9/2003 | Cook et al. | |
| 2003/0217865 | A1 | 11/2003 | Simpson et al. | |
| 2003/0221519 | A1 | 12/2003 | Haugen | |
| 2004/0003490 | A1 | 1/2004 | Shahin et al. | |
| 2004/0003944 | A1 | 1/2004 | Vincent et al. | |
| 2004/0011534 | A1 | 1/2004 | Simonds et al. | |
| 2004/0060697 | A1 | 4/2004 | Tilton et al. | |
| 2004/0069501 | A1 | 4/2004 | Haugen et al. | |
| 2004/0108142 | A1 | 6/2004 | Vail, III | |
| 2004/0112603 | A1 | 6/2004 | Galloway et al. | |
| 2004/0112646 | A1 | 6/2004 | Vail | |
| 2004/0118613 | A1 | 6/2004 | Vail | |
| 2004/0118614 | A1 | 6/2004 | Galloway et al. | |
| 2004/0123984 | A1 | 7/2004 | Vail | |
| 2004/0124010 | A1 | 7/2004 | Galloway et al. | |
| 2004/0124011 | A1 | 7/2004 | Gledhill et al. | |
| 2004/0124015 | A1 | 7/2004 | Vaile et al. | |
| 2004/0129456 | A1 | 7/2004 | Vail | |
| 2004/0140128 | A1 | 7/2004 | Vail | |
| 2004/0144547 | A1 | 7/2004 | Koithan et al. | |
| 2004/0173358 | A1 | 9/2004 | Haugen | |
| 2004/0216892 | A1 | 11/2004 | Giroux et al. | |
| 2004/0216924 | A1 | 11/2004 | Pietras et al. | |
| 2004/0216925 | A1 | 11/2004 | Metcalfe et al. | |
| 2004/0221997 | A1 | 11/2004 | Giroux et al. | |
| 2004/0226751 | A1 | 11/2004 | McKay et al. | |
| 2004/0244992 | A1 | 12/2004 | Carter et al. | |
| 2004/0245020 | A1 | 12/2004 | Giroux et al. | |
| 2004/0251025 | A1 | 12/2004 | Giroux et al. | |
| 2004/0251050 | A1 | 12/2004 | Shahin et al. | |
| 2004/0251055 | A1 | 12/2004 | Shahin et al. | |
| 2004/0262013 | A1 | 12/2004 | Tilton et al. | |
| 2005/0000691 | A1 | 1/2005 | Giroux et al. | |
| 2005/0096846 | A1 | 5/2005 | Koithan et al. | |

FOREIGN PATENT DOCUMENTS

| | | |
|---|---|---|
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |
| GB | 2 201 912 | 9/1988 |
| GB | 2 216 926 | 10/1989 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 345 074 | 6/2000 |
| GB | 2 347 445 | 9/2000 |
| GB | 2 348 223 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 381 809 | 5/2003 |
| GB | 2 382 361 | 5/2003 |
| GB | 2 386 626 | 9/2003 |

| | | |
|---|---|---|
| GB | 2 389 130 | 12/2003 |
| SU | 112631 | 1/1956 |
| SU | 659260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| SU | 1618870 | 1/1991 |
| SU | 1808972 | 5/1991 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93-07358 | 4/1993 |
| WO | WO 93/24728 | 12/1993 |
| WO | WO 95/10686 | 4/1995 |
| WO | WO 96-18799 | 6/1996 |
| WO | WO 96/28635 | 9/1996 |
| WO | WO 97-05360 | 2/1997 |
| WO | WO 97/08418 | 3/1997 |
| WO | WO 98/01651 | 1/1998 |
| WO | WO 98-05844 | 2/1998 |
| WO | WO 98/09053 | 3/1998 |
| WO | WO 98-11322 | 3/1998 |
| WO | WO 98-32948 | 7/1998 |
| WO | WO 98/55730 | 12/1998 |
| WO | WO 99-04135 | 1/1999 |
| WO | WO 99/11902 | 3/1999 |
| WO | WO 99/23354 | 5/1999 |
| WO | WO 99-24689 | 5/1999 |
| WO | WO 99-35368 | 7/1999 |
| WO | WO 99/37881 | 7/1999 |
| WO | WO 99-41485 | 8/1999 |
| WO | WO 99/50528 | 10/1999 |
| WO | WO 99-58810 | 11/1999 |
| WO | WO 99/64713 | 12/1999 |
| WO | WO 00/04269 | 1/2000 |
| WO | WO 00/05483 | 2/2000 |
| WO | WO 00/08293 | 2/2000 |
| WO | WO 00/09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00-39429 | 7/2000 |
| WO | WO 00-39430 | 7/2000 |
| WO | WO 00/41487 | 7/2000 |
| WO | WO 00-46484 | 8/2000 |
| WO | WO 00/50730 | 8/2000 |
| WO | WO 00-66879 | 11/2000 |
| WO | WO 01/12946 | 2/2001 |
| WO | WO 01/46550 | 6/2001 |
| WO | WO 01/48352 | 7/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/03155 | 1/2002 |
| WO | WO 02/03156 | 1/2002 |
| WO | WO 02/14649 | 2/2002 |
| WO | WO 02-44601 | 6/2002 |
| WO | WO 02-081863 | 10/2002 |
| WO | WO 02/086287 | 10/2002 |
| WO | WO 03/006790 | 1/2003 |
| WO | WO 03-074836 | 9/2003 |
| WO | WO 03-087525 | 10/2003 |
| WO | WO 2004/022903 | 3/2004 |

OTHER PUBLICATIONS

A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.

G. F. Boykin, The Role of A Worldwide Drilling Organization and the Road to the Future, SPE/IADC 37630, 1997.

M. S. Fuller, M. Littler, and I. Pollock, Innovative Way To Cement a Liner Utilizing a New Inner String Liner Cementing Process, 1998.

Helio Santos, Consequences and Relevance of Drillstring Vibration on Wellbore Stability, SPE/IADC 52820, 1999.

Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.

C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.

Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.

Mike Bullock, Tom Grant, Rick Sizemore, Chan Daigle, and Pat York, Using Expandable Solid Tubulars To Solve Well Construction Challenges In Deep Waters And Maturing Properities, IBP 27500, Brazilian Petroleum Institute—IBP, 2000.

Coiled Tubing Handbook, World Oil, Gulf Publishing Company, 1993.

Tessari, et al., "Retrievable Tools Provide Flexibility for Casing Drilling," Paper No. WOCD-0306-01, World Oil Casing Drilling Technical Conference, 2003, pp. 1-11.

Detlef Hahn, Friedhelm Makohl, and Larry Watkins, Casing-While Drilling System Reduces Hole Collapse Risks, Offshore, pp. 54, 56, and 59, Feb. 1998.

Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Valves Wellhead Equipment Safety Systems, W-K-M Division, ACF Industries, Catalog 80, 1980, 5 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.
U.S. Appl. No. 10/618,093, filed Jul. 11, 2003, Boyle.
U.S. Appl. No. 10/189,570, filed Jul. 6, 2002, Vail.
Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.
M.B. Stone and J. Smith, "Expandable Tubulars and Casing Drilling are Options" Drilling Contractor, Jan./Feb. 2002, pp. 52.
M. Gelfgat, "Retractable Bits Development and Application" Transactions of the ASME, vol. 120, Jun. 1998, pp. 124-130.
"First Success with Casing-Drilling" Word Oil, Feb. 1999, pp. 25.
Dean E. Gaddy, Editor, "Russia Shares Technical Know-How with U.S." Oil & Gas Journal, Mar. 1999, pp. 51-52 and 54-56.
U.S. Appl. No. 10/794,800, filed Mar. 5, 2004.
U.S. Appl. No. 10/832,804, filed Apr. 27, 2004.
U.S. Appl. No. 10/795,214, filed Mar. 5, 2004.
U.S. Appl. No. 10/794,795, filed Mar. 5, 2004.
U.S. Appl. No. 10/775,048, filed Feb. 9, 2004.
U.S. Appl. No. 10/772,217, filed Feb. 2, 2004.
U.S. Appl. No. 10/788,976, filed Feb. 27, 2004.
U.S. Appl. No. 10/794,797, filed Mar. 5, 2004.
U.S. Appl. No. 10/767,322, filed Jan. 29, 2004.
U.S. Appl. No. 10/795,129, filed Mar. 5, 2004.
U.S. Appl. No. 10/794,790, filed Mar. 5, 2004.
U.S. Appl. No. 10/162,302, filed Jun. 4, 2004.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
U.K. Search Report, Application No. GB 0328864.4, dated May 12, 2004.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Jafer, et al., "Discussion And Comparison Of Performance Of Horizontal Wells In Bouri Field," SPE Paper 36927, SPE Annual Technical Conference And Exhibition, Oct. 22-24, 1996, pp. 465-473.
Boykin, "The Role Of A Worldwide Drilling Organization And The Road To The Future," SPE/IADC Paper 37630, SPE/IADC Drilling Conference, Mar. 4-6, 1997, pp. 489-498.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Santos, et al., "Consequences And Relevance Of Drillstring Vibration On Wellbore Stability," SPE/IADC Paper 52820, SPE/IADC Drilling Conference, Mar. 9-11, 1999, pp. 25-31.
Silverman, "Novel Drilling Method—Casing Drilling Process Eliminates Tripping String," Petroleum Engineer International, Mar. 1999, p. 15.
Silverman, "Drilling Technology—Retracable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.

Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Flippov, et al., "Expandable Tubular Solutions," SPE paper 56500, SPE Annual Technical Conference And Exhibition, Oct. 3-6, 1999, pp. 1-16.
Lohefer, et al., "Expandable Liner Hanger Provides Cost-Effective Alternative Solution," IADC/SPE Paper 59151, IADC/SPE Drilling Conference, Feb. 23-25, 2000, pp. 1-12.
Daigle, et al., "Expandable Tubulars: Field Examples Of Application In Well Construction And Remediation," SPE Paper 62958, SPE Annual Technical Conference And Exhibition, Oct. 1-4, 2000, pp. 1-14.
Dupal, et al., "Solid Expandable Tubular Technology—A Year Of Case Histories In The Drilling Environment," SPE/IADC Paper 67770, SP:E/IADC Drilling Conference, Feb. 27-Mar. 1, 2001, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Fuller, et al., "Innovative Way To Cement A Liner Utilizing A New Liner String Liner Cementing Process," IADC/SPE Paper 39349, IADC/SPE Drilling Conference, Mar. 3-6, 1998, pp. 501-504.
Coronado, et al., "A One-Trip External-Casing-Packer Cement-Inflation And Stage-Cementing System," Journal Of Petroleum Technology, Aug. 1998, pp. 76-77.
Camesa, Inc., "Electromechanical Cable," Dec. 1998, pp. 1-32.
The Rochester Corporation, "Well Logging Cables," Jul. 1999, 9 pages.
Quigley, "Coiled Tubing And Its Applications," SPE Short Course, Houston, Texas, Oct. 3, 1999, 9 pages.
"World Oil's Coiled Tubing handbook," Gulf Publishing Co., 1993, p. 3, p. 5, pp. 45-50.
Sas-Joworsky, et al., "Development Of Composite Coiled Tubing For Oilfield Services," SPE Paper 26536, SPE Annual Technical Conference And Exhibition, Oct. 3-6, 1993, pp. 1-15.
Hallundbaek, "Well Tractors For Highly Deviated And Horizontal Wells," SPE paper 028871, SPE European Petroleum Conference, Oct. 25-27, 1994, pp. 57-62.
Leising, et al., "Extending The Reach Of Coiled Tubing Drilling (thrusters, Equalizers And Tractors)," SPE/IADC Paper 37656, SPE/IADC Drilling Conference, Mar. 4-6, 1997, pp. 677-690.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Ananconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Bullock, et al., "Using Expandable Solid Tubulars To Solve Well Construction Challenges In Deep Waters And Maturing Properites," IBP Paper 275 00, Rio Oil & Gas Conference, Oct. 16-19, 2000, pp. 1-4.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
McSpadden, et al., "Field Validation Of 3-Dimensional Drag Model For Tractor And Cable-Conveyed Well Intervention," SPE Paper 71560, SPE Annual Technical Confernece And Exhibition, Sep. 30-Oct. 3, 2001, pp. 1-8.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Editor, "New Downhole Tractor Put To Work," World Oil, Jun. 2000, pp. 75-76.
Henderson, et al., "Cost Saving Benefits Of Using A Fully Bi-Directional Tractor System," SPE/Petroleum Society Of CIM Paper 65467, SPE/Petroleum Society Of CIM International Conference On Horizontal Well Technology, Nov. 6-8, 2000, pp. 1-3.
Editor, "Shell Runs Smart Robot Tractor," Hart's E & P, Oct. 2002, p. 28.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.

* cited by examiner

APPARATUS AND METHOD OF DRILLING WITH CASING

CROSS-REFERENCE TO RELATED APPLICATIONS

This application is a continuation of U.S. patent application Ser. No. 10/319,792, filed Dec. 13, 2002, now U.S. Pat No. 6,899,186. The aforementioned related patent application is herein incorporated by reference.

BACKGROUND OF THE INVENTION

1. Field of the Invention

The present invention relates to wellbore completion. More particularly, the invention relates to methods for drilling with casing and landing a casing mandrel in a subsea wellhead.

2. Description of the Related Art

In a conventional completion operation, a wellbore is formed in several phases. In a first phase, the wellbore is formed using a drill bit that is urged downwardly at a lower end of a drill string while simultaneously circulating drilling mud into the wellbore. The drilling mud is circulated downhole to carry rock chips to the surface and to cool and clean the bit. After drilling a predetermined depth, the drill string and bit are removed.

In a next phase, the wellbore is lined with a string of steel pipe called casing. The casing is inserted into the newly formed wellbore to provide support to the wellbore and facilitate the isolation of certain areas of the wellbore adjacent to hydrocarbon bearing formations. Generally, a casing shoe is attached to the bottom of the casing string to facilitate the passage of cement that will fill an annular area defined between the casing and the wellbore.

A recent trend in well completion has been the advent of one-pass drilling, otherwise known as "drilling with casing". It has been discovered that drilling with casing is a time effective method of forming a wellbore where a drill bit is attached to the same string of tubulars that will line the wellbore. In other words, rather than run a drill bit on smaller diameter drill string, the bit or drillshoe is run at the end of larger diameter tubing or casing that will remain in the wellbore and be cemented therein. The advantages of drilling with casing are obvious. Because the same string of tubulars transports the bit as it lines the wellbore, no separate trip into the wellbore is necessary between the forming of the wellbore and the lining of the wellbore.

Drilling with casing is especially useful in certain situations where an operator wants to drill and line a wellbore as quickly as possible to minimize the time the wellbore remains unlined and subject to collapse or the effects of pressure anomalies. For example, when forming a subsea wellbore, the initial length of wellbore extending downwards from the ocean floor is subject to cave in or collapse due to soft formations at the ocean floor. Additionally, sections of a wellbore that intersect areas of high pressure can lead to damage of the wellbore between the time the wellbore is formed and when it is lined. An area of exceptionally low pressure will drain expensive drilling fluid from the wellbore between the time it is intersected and when the wellbore is lined. In each of these instances, the problems can be eliminated or their effects reduced by drilling with casing.

While one-pass drilling offers obvious advantages over a conventional completion operation, there are some additional problems using the technology to form a subsea well because of the sealing requirements necessary in a high-pressure environment at the ocean floor. Generally, the subsea wellhead comprises a casing hanger with a locking mechanism and a landing shoulder while the string of casing includes a sealing assembly and a casing mandrel for landing in the wellhead. Typically, the subsea wellbore is drilled to a depth greater than the length of the casing, thereby allowing the casing string and the casing mandrel to easily seat in the wellhead as the string of casing is inserted into the subsea wellbore. However, in a one-pass completion operation, the casing is rotated as the wellbore is formed and landing the casing mandrel in the wellhead would necessarily involve rotating the sealing surfaces of the casing mandrel and the sealing surfaces of the wellhead. Additionally, in one-pass completion an obstruction may be encountered while drilling with casing, whereby the casing hanger may not be able to move axially downward far enough to land in the subsea wellhead, resulting in the inability to seal the subsea wellhead.

A need therefore exists for a method of drilling with casing that facilitates the landing of a casing hanger in a subsea wellhead. There is a further need for a method that prevents damage to the seal assembly as the casing mandrel seats in the casing hanger. There is yet a further need for a method for landing a casing hanger in a subsea wellhead after an obstruction is encountered during the drilling operation.

SUMMARY OF THE INVENTION

The present invention generally relates to methods for drilling a subsea wellbore and landing a casing mandrel in a subsea wellhead. In one aspect, a method of drilling a subsea wellbore with casing is provided. The method includes placing a string of casing with a drill bit at the lower end thereof in a riser system and urging the string of casing axially downward. The method further includes reducing the axial length of the string of casing to land a wellbore component in a subsea wellhead. In this manner, the wellbore is formed and lined with the string of casing in a single run.

In another aspect, a method of forming and lining a subsea wellbore is provided. The method includes disposing a run-in string with a casing string at the lower end thereof in a riser system, the casing string having a casing mandrel disposed at an upper end thereof and a drill bit disposed at a lower end thereof. The method further includes rotating the casing string while urging the casing string axially downward to a predetermined depth, whereby the casing mandrel is at a predetermined height above a casing hanger. Additionally, the method includes reducing the length of the casing string thereby seating the casing mandrel in the casing hanger.

In yet another aspect, a method of landing a casing mandrel in a casing hanger disposed in a subsea wellhead is provided. The method includes placing a casing string with the casing mandrel disposed at the upper end thereof into a riser system and drilling the casing string into the subsea wellhead to form a wellbore. The method further includes positioning the casing mandrel at a predetermined height above the casing hanger and reducing the axial length of the casing string to seat the casing mandrel in the casing hanger.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
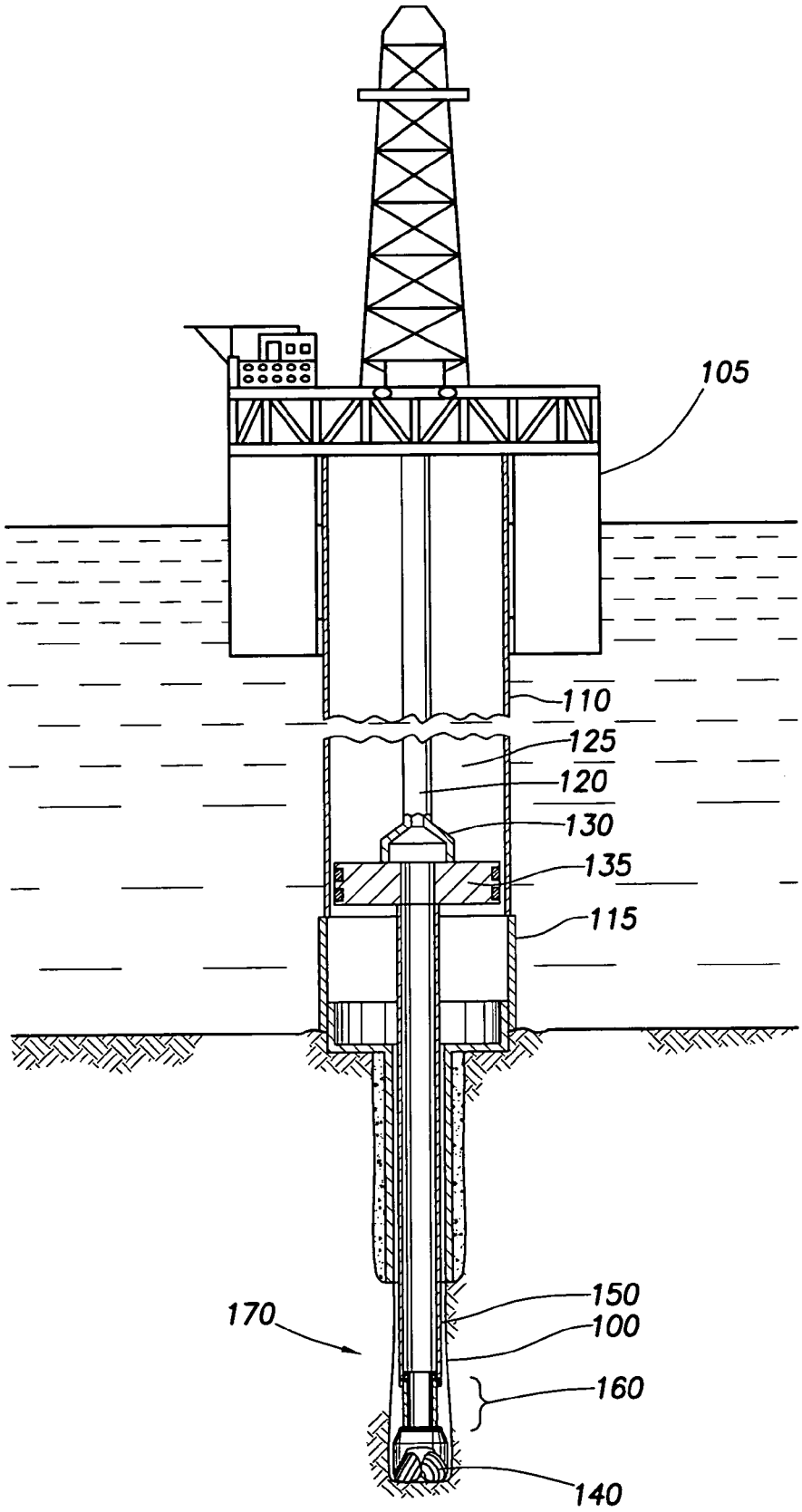
FIG. 1 is a partial section view and illustrates the formation of a subsea wellbore with a casing string having a drill bit disposed at a lower end thereof.

The present invention generally relates to drilling a subsea wellbore using a casing string. FIG. 1 illustrates a drilling operation of a subsea wellbore with a casing assembly 170 in accordance with the present invention. Typically, most offshore drilling in deep water is conducted from a floating vessel 105 that supports the drill rig and derrick and associated drilling equipment. A riser pipe 110 is normally used to interconnect the floating vessel 105 and a subsea wellhead 115. A run-in string 120 extends from the floating vessel 105 through the riser pipe 110. The riser pipe 110 serves to guide the run-in string 120 into the subsea wellhead 115 and to conduct returning drilling fluid back to the floating vessel 105 during the drilling operation through an annulus 125 created between the riser pipe 110 and run-in string 120. The riser pipe 110 is illustrated larger than a standard riser pipe for clarity.

A running tool 130 is disposed at the lower end of the run-in string 120. Generally, the running tool 130 is used in the placement or setting of downhole equipment and may be retrieved after the operation or setting process. The running tool 130 in this invention is used to connect the run-in string 120 to the casing assembly 170 and subsequently release the casing assembly 170 after the wellbore 100 is formed.

The casing assembly 170 is constructed of a casing mandrel 135, a string of casing 150 and a collapsible apparatus 160. The casing mandrel 135 is disposed at the upper end of the string of casing 150. The casing mandrel 135 is constructed and arranged to seal and secure the string of casing 150 in the subsea wellhead 115. As shown on FIG. 1, a collapsible apparatus 160 is disposed at the bottom of the string of casing 150. However, it should be noted that the collapsible apparatus 160 is not limited to the location illustrated on FIG. 1, but may be located at any point on the string of casing 150.

Figure 8A:
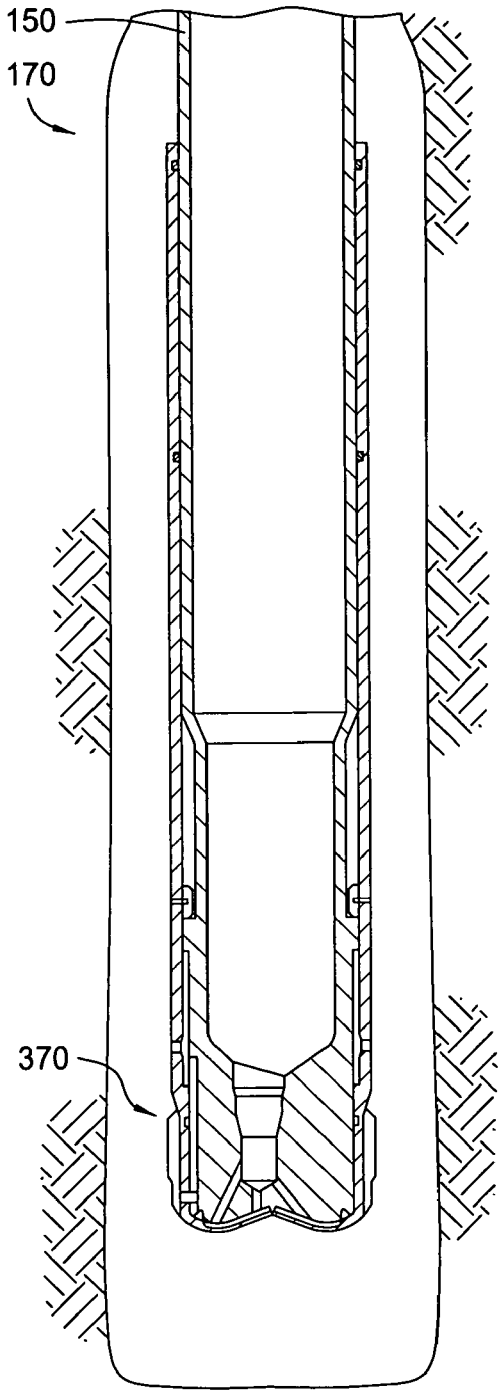
FIGS. 8A is a cross-sectional view illustrating the casing assembly with a casing drilling shoe.
Figure 8B:
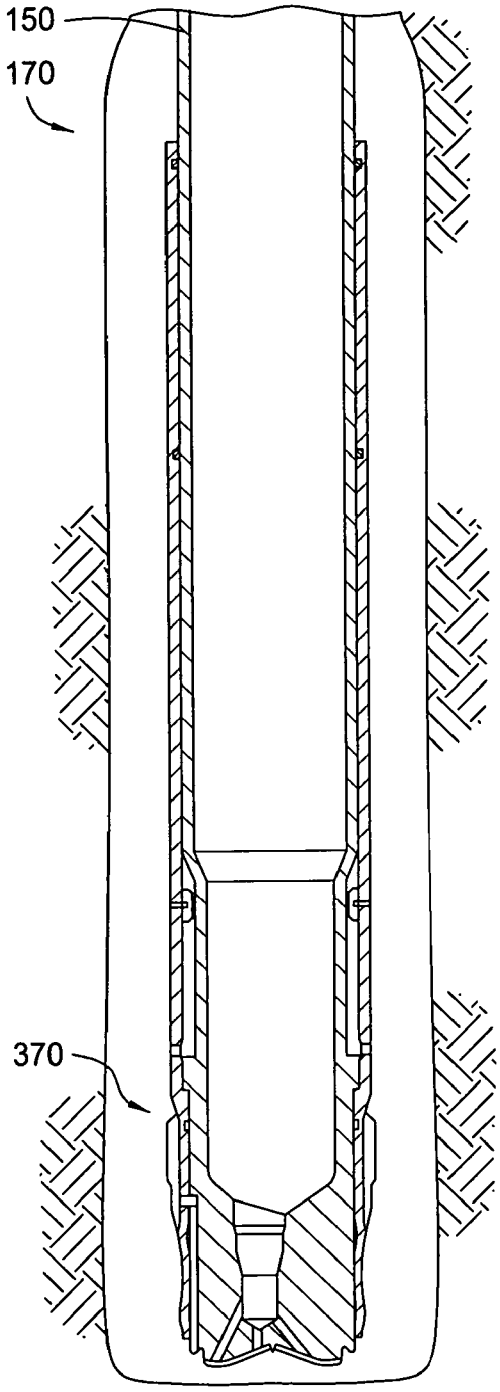
FIG. 8B is a cross-sectional view illustrating the casing assembly with a casing drilling shoe.

A drill bit 140 is disposed at the lowest point on the casing assembly 170 to form the wellbore 100. In the embodiment shown, the drill bit 140 is rotated with the casing assembly 170. Alternatively, mud motor (not shown) may be used near the end of the string of casing 150 to rotate the bit 140. In another embodiment, a casing drilling shoe 370 may be employed at the lower end of the casing assembly 170, as illustrated in FIGS. 8A and 8B. An example of a casing drilling shoe is disclosed in Wardley, U.S. Pat. No. 6,443,247 which is incorporated herein in its entirety. Generally, the casing drilling shoe disclosed in '247 includes an outer drilling section constructed of a relatively hard material such as steel, and an inner section constructed of a readily drillable material such as aluminum. The drilling shoe further includes a device for controllably displacing the outer drilling section to enable the shoe to be drilled through using a standard drill bit and subsequently penetrated by a reduced diameter casing string or liner.

As illustrated by the embodiment shown in FIG. 1, the wellbore 100 is formed as the casing assembly 170 is rotated and urged downward. Typically, drilling fluid is pumped through the run-in string 120 and the string of casing 150 to the drill bit 140. A motor (not shown) rotates the run-in string 120 and the run-in string 120 transmits rotational torque to the casing assembly 170 and the drill bit 140. At the same time, the run-in string 120, the running tool 130, the casing assembly 170 and drill bit 140 are urged downward. In this respect, the run-in string 120, the running tool 130 and the casing assembly 170 act as one rotationally locked unit to form a predetermined length of wellbore 100 as shown on FIG. 2.

Figure 2:
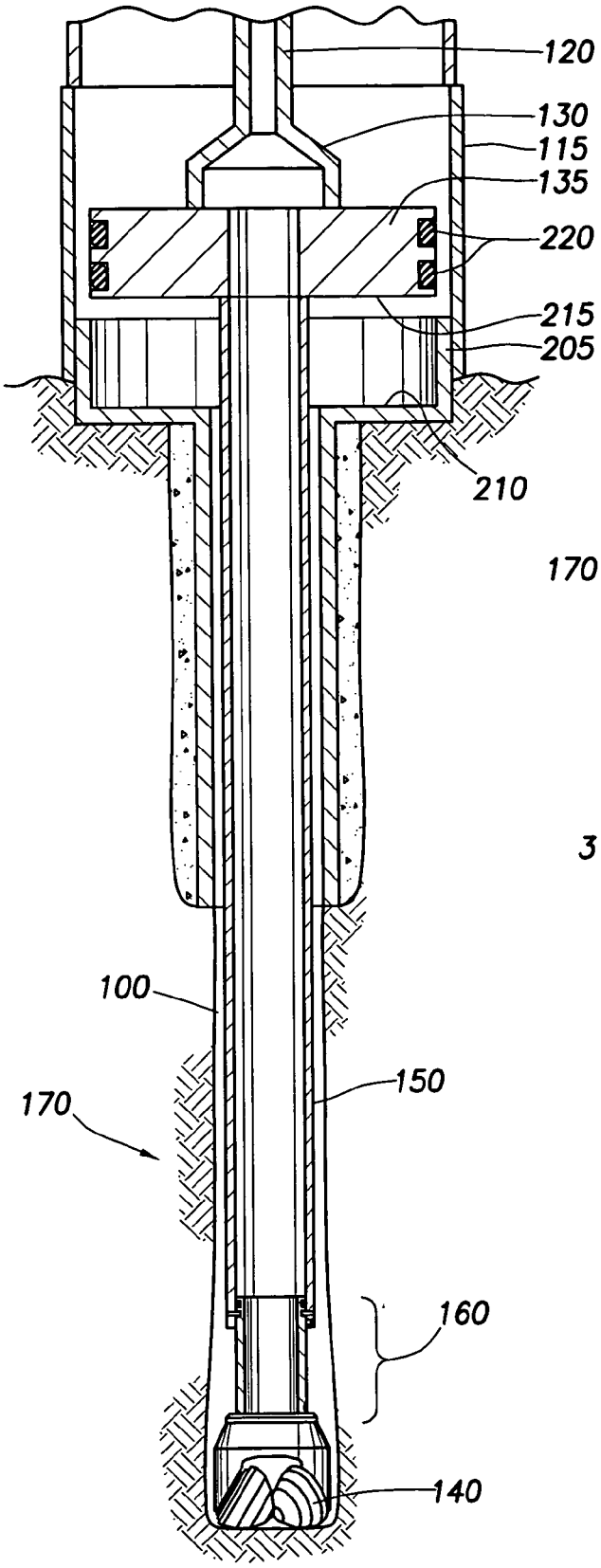
FIG. 2 is a cross-sectional view illustrating the string of casing prior to setting a casing mandrel into a casing hanger of the subsea wellhead.

FIG. 2 is a cross-sectional view illustrating the casing assembly 170 prior to setting the casing mandrel 135 into a casing hanger 205. Generally, the wellbore 100 is formed to a predetermined depth and thereafter the rotation of the casing assembly 170 is stopped. Typically, the predetermined depth is a point where a lower surface 215 on the casing mandrel 135 is a predetermined height above an upper portion of the casing hanger 205 in the subsea wellhead 115 as shown in FIG. 2.

The casing mandrel 135 is typically constructed and arranged from steel that has a smooth metallic face. However, other types of materials may be employed, so long as the material will permit an effective seal between the casing mandrel 135 and the casing hanger 205. The casing mandrel 135 may further include one or more seals 220 disposed around an outer portion of the casing mandrel 135. The one or more seals 220 are later used to create a seal between the casing mandrel 135 and the casing hanger 205.

As shown in FIG. 2, the casing hanger 205 is disposed in the subsea surface. Typically, the casing hanger 205 is located and cemented in the subsea surface prior to drilling the wellbore 100. The casing hanger 205 is typically constructed from steel. However, other types of materials may be employed so long as the material will permit an effective seal between the casing mandrel 135 and the casing hanger 205. The casing hanger 205 includes a landing shoulder 210 formed at the lower end of the casing hanger 205 to mate with the lower surface 215 formed on the lower end of the casing mandrel 135.

Figure 3:
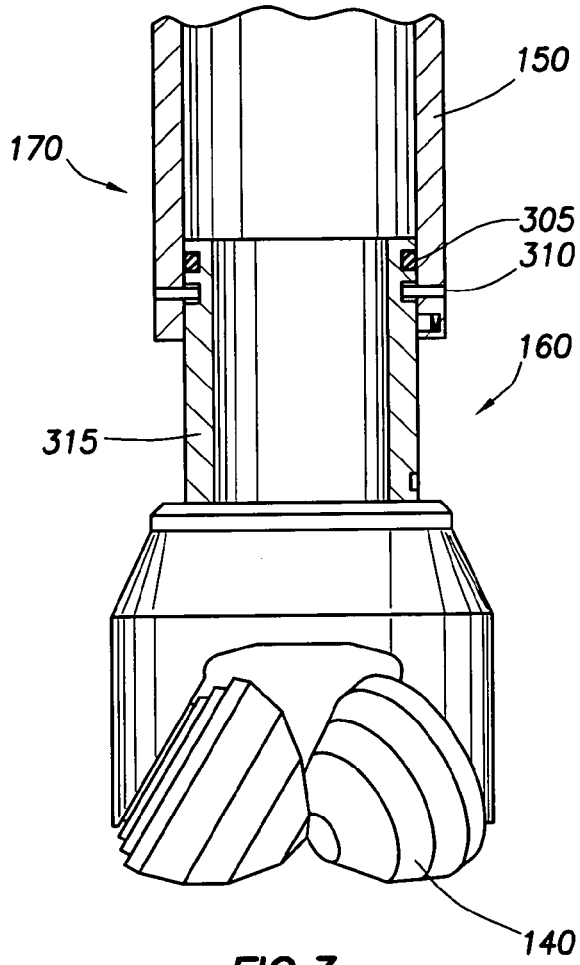
FIG. 3 is an enlarged cross-sectional view illustrating a collapsible apparatus of the casing string in a first position.

FIG. 3 is an enlarged cross-sectional view illustrating the collapsible apparatus 160 in a first position. Generally, the collapsible apparatus 160 moves between the first position and a second position allowing the overall length of the casing assembly 170 to be reduced. As the casing assembly 170 length is reduced, the casing mandrel 135 may seat in the casing hanger 205 sealing the subsea wellhead 115 without damaging the one or more seals 220. In another aspect, reducing the axial length of the casing assembly 170 also provides a means for landing the casing mandrel 135 in the casing hanger 205 after an obstruction is encountered during the drilling operation, whereby the casing assembly 170 can no longer urged axially downward to seal off the subsea wellhead 115.

As illustrated, the collapsible apparatus 160 includes one or more seals 305 to create a seal between the string of casing 150 and a tubular member 315. The tubular member 315 is constructed of a predetermined length to allow the casing mandrel 135 to seat properly in the casing hanger 205.

Figure 4:
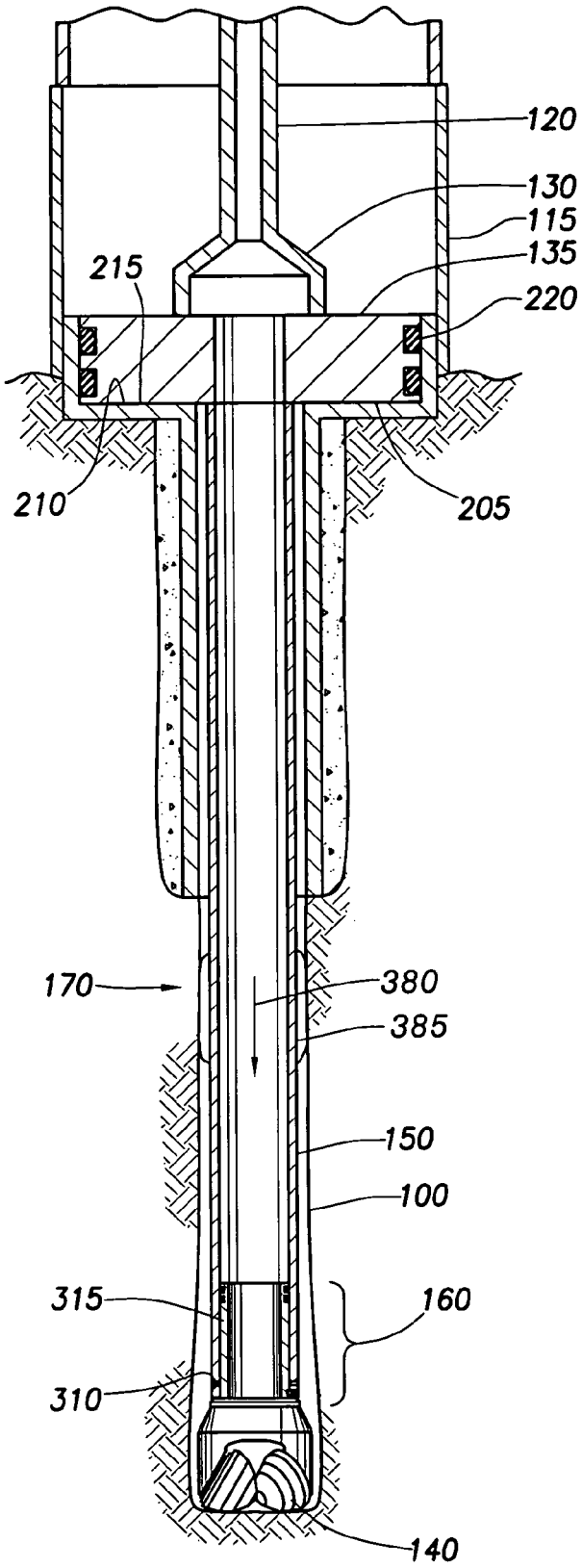
FIG. 4 is a cross-sectional view illustrating the casing assembly after the casing mandrel is seated in the casing hanger.

The tubular member 315 is secured axially to the string of casing 150 by a locking mechanism 310. The locking mechanism 310 is illustrated as a shear pin. However, other forms of locking mechanisms may be employed, so long as the locking mechanism will fail at a predetermined force. Generally, the locking mechanism 310 is short piece of metal that is used to retain tubular member 315 and the string of casing 150 in a fixed position until sufficient axial force is applied to cause the locking mechanism to fail. Once the locking mechanism 310 fails, the string of casing 150 may then move axially downward to reduce the length of the casing assembly 170. Typically, a mechanical or hydraulic axial force is applied to the casing assembly 170, thereby causing the locking mechanism 310 to fail. Alternatively, a wireline apparatus (not shown) may be run through the casing assembly 170 and employed to provide the axial force required to cause the locking mechanism 310 to fail. In an alternative embodiment, the locking mechanism 310 is constructed and arranged to deactivate upon receipt of a signal 380 from the surface, as illustrated in FIG. 4. The signal 380 may be axial, torsional or combinations thereof and the signal 380 may be transmitted through wired casing, wireline, hydraulics or any other means well known in the art.

In addition to securing the tubular member 315 axially to the string of casing 150, the locking mechanism 310 also provides a means for a mechanical torque connection. In other words, as the string of casing 150 is rotated the torsional force is transmitted to the collapsible apparatus 160 through the locking mechanism 310. Alternatively, a spline assembly may be employed to transmit the torsional force between the string of casing 150 and the collapsible apparatus 160. Generally, a spline assembly is a mechanical torque connection between a first and second member. Typically, the first member includes a plurality of keys and the second member includes a plurality of keyways. When rotational torque is applied to the first member, the keys act on the keyways to transmit the torque to the second member. Additionally, the spline assembly may be disengaged by axial movement of one member relative to the other member, thereby permitting rotational freedom of each member.

FIG. 4 is a cross-sectional view illustrating the casing assembly 170 after the casing mandrel 135 is seated in the casing hanger 205. A mechanical or hydraulic axial force was applied to the casing assembly 170 causing the locking mechanism 310 to fail and allow the string of casing 150 to move axially downward and slide over the tubular member 315. It is to be understood, however, that the collapsible apparatus 160 may be constructed and arranged to permit the string of casing 150 to slide inside the tubular member 315 to obtain the same desired result.

As illustrated on FIG. 4, the lower surface 215 has contacted the landing shoulder 210, thereby seating the casing mandrel 135 in the casing hanger 205. As further illustrated, the one or more seals 220 on the casing mandrel 135 are in contact with the casing hanger 205, thereby creating a fluid tight seal between the casing mandrel 135 in the casing hanger 205 during the drilling and cementing operations. In this manner, the length of the casing assembly 170 is reduced allowing the casing mandrel 135 to seat in the casing hanger 205.

Figure 5A:
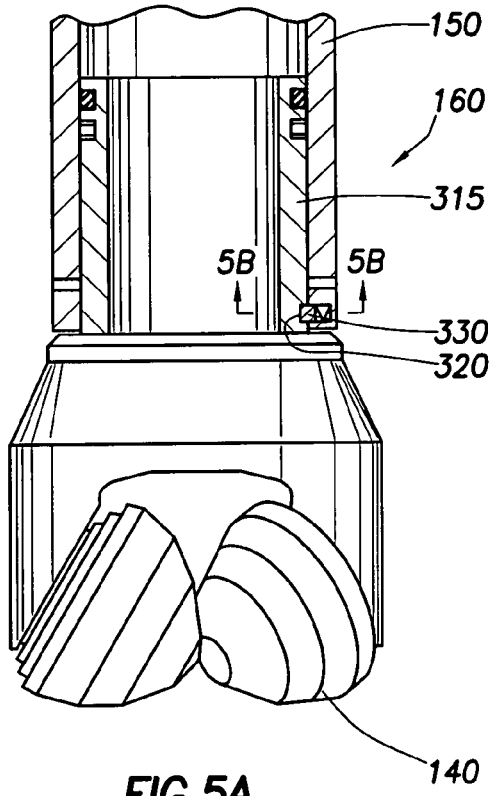
FIG. 5A is an enlarged cross-sectional view illustrating the collapsible apparatus in a second position after the casing mandrel is set into the casing hanger.

FIG. 5A is an enlarged cross-sectional view illustrating the collapsible apparatus 160 in the second position after the casing mandrel 135 is seated in the casing hanger 205. As illustrated, the locking mechanism 310 has released the connection point between the string of casing 150 and the tubular member 315, thereby allowing the string of casing 150 to slide axially downward toward the bit 140. The axial downward movement of the string of casing 150 permits an inwardly biased torque key 330 to engage a groove 320 at the lower end of the tubular member 315. The torque key 330 creates a mechanical torque connection between the string of casing 150 and the collapsible apparatus 160 when the collapsible apparatus 160 is in the second position. Alternatively, a mechanical spline assembly may be used to create a torque connection between the string of casing 150 and the collapsible apparatus 160.

In another aspect, the axial movement of the collapsible apparatus 160 from the first position to the second position may be used to activate other downhole components. For example, the axial movement of the collapsible apparatus 160 may displace an outer drilling section of a drilling shoe (not shown) to allow the drilling shoe to be drilled therethrough, as discussed in a previous paragraph relating to Wardley, U.S. Pat. No. 6,443,247. In another example, the axial movement of the collapsible apparatus 160 may urge a sleeve in a float apparatus (not shown) from a first position to a second position to activate the float apparatus.

Figure 5B:
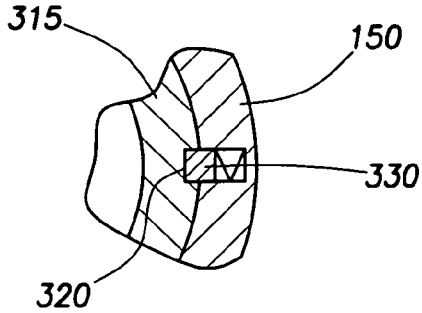
FIG. 5B is a cross-sectional view taken along line 5B—5B of FIG. 5A illustrating a torque key engaged between the string of casing and a tubular member in the collapsible apparatus.

FIG. 5B is a cross-sectional view taken along line 5B—5B of FIG. 5A illustrating the torque key 330 engaged between the string of casing 150 and the tubular member 315. As shown, the torque key 330 has moved radially inward, thereby establishing a mechanical connection between the string of casing 150 and the tubular member 315.

In an alternative embodiment, the casing assembly 170 may be drilled down until the lower surface 215 of the casing mandrel 135 is right above the upper portion of the casing hanger 205. Thereafter, the rotation of the casing assembly 170 is stopped. Next, the run-in string 120 is allowed to slack off causing all or part of the string of casing 150 to be in compression, which reduces the length of the string of casing 150. Subsequently, the reduction of length in the string of casing 150 allows the casing mandrel 135 to seat into the casing hanger 205.

In a further alternative embodiment, a centralizer 385, as illustrated in FIG. 4, may be disposed on the string of casing 150 to position the string of casing 150 concentrically in the wellbore 100. Generally, a centralizer is usually used during cementing operations to provide a constant annular space around the string of casing 150, rather than having the string of casing 150 laying eccentrically against the wellbore 100 wall. For straight holes, bow spring centralizers are sufficient and commonly employed. For deviated wellbores, where gravitational force pulls the string of casing 150 to the low side of the hole, more robust solid-bladed centralizers are employed.

Figure 6A:
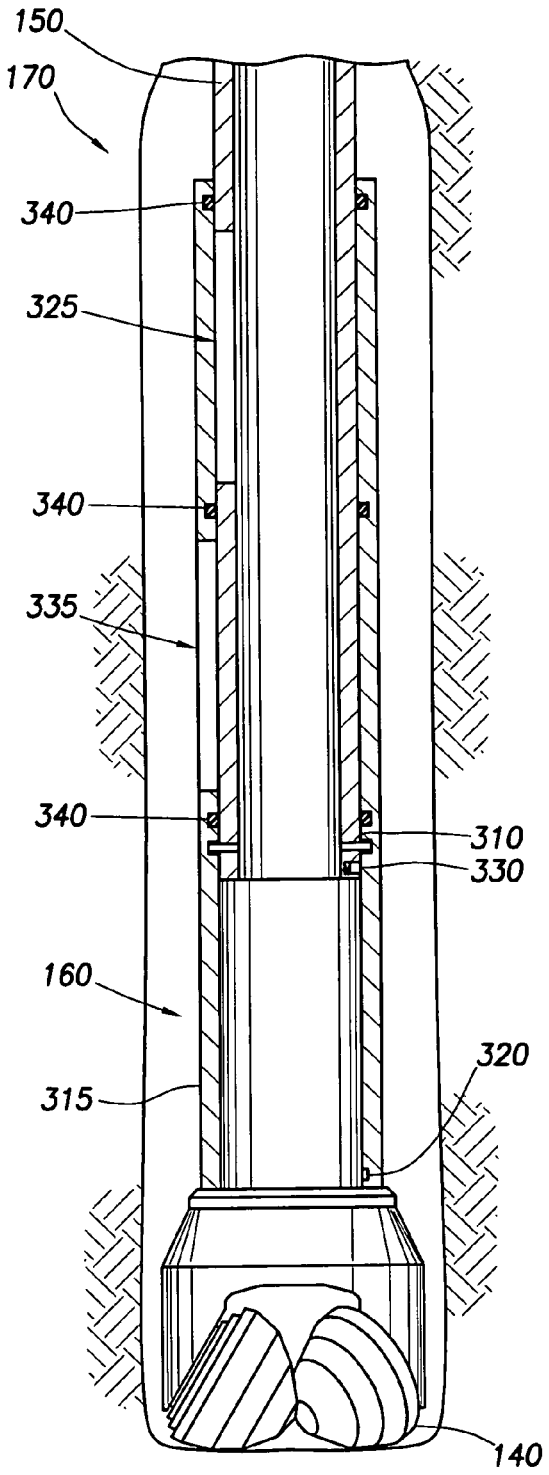
FIG. 6A is a cross-sectional view of an alternative embodiment illustrating pre-milled windows in the casing assembly.

FIG. 6A is a cross-sectional view of an alternative embodiment illustrating pre-milled windows 325, 335 in the casing assembly 170. In the embodiment shown, the pre-milled window 325 is formed in a lower portion of the string of casing 150. Pre-milled window 325 is constructed and arranged to align with pre-milled window 335 formed in the tubular member 315 after the collapsible apparatus 160 has moved to the second position. Additionally, a plurality of seals 340 are disposed around the string of casing 150 to create a fluid tight seal between the string of casing 150 and the tubular member 315.

Figure 6B:
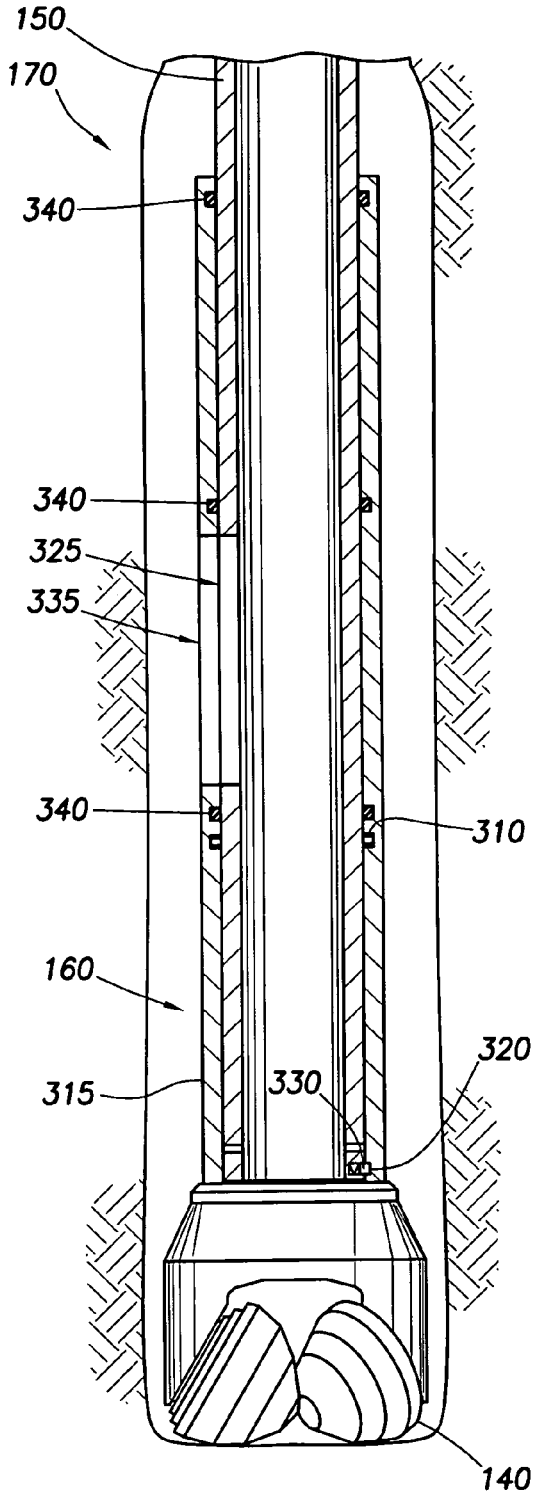
FIG. 6B is a cross-sectional view illustrating the casing assembly after alignment of the pre-milled windows.

FIG. 6B is a cross-sectional view illustrating the casing assembly 170 after alignment of the pre-milled windows 325, 335. As shown, the locking mechanism 310 has failed in a manner discussed in a previous paragraph, and the collapsible apparatus 160 has moved to the second position permitting the axial alignment of the pre-milled windows 325, 335. Additionally, the inwardly biased torque key 330 has engaged the groove 320 formed at the lower end of the tubular member 315, thereby rotationally aligning the pre-milled windows 325, 335. In this manner, the pre-milled windows 325, 335 are aligned both axially and rotationally to provide an access window between the inner portion of the casing assembly 170 and the surrounding wellbore 100.

Figure 6C:
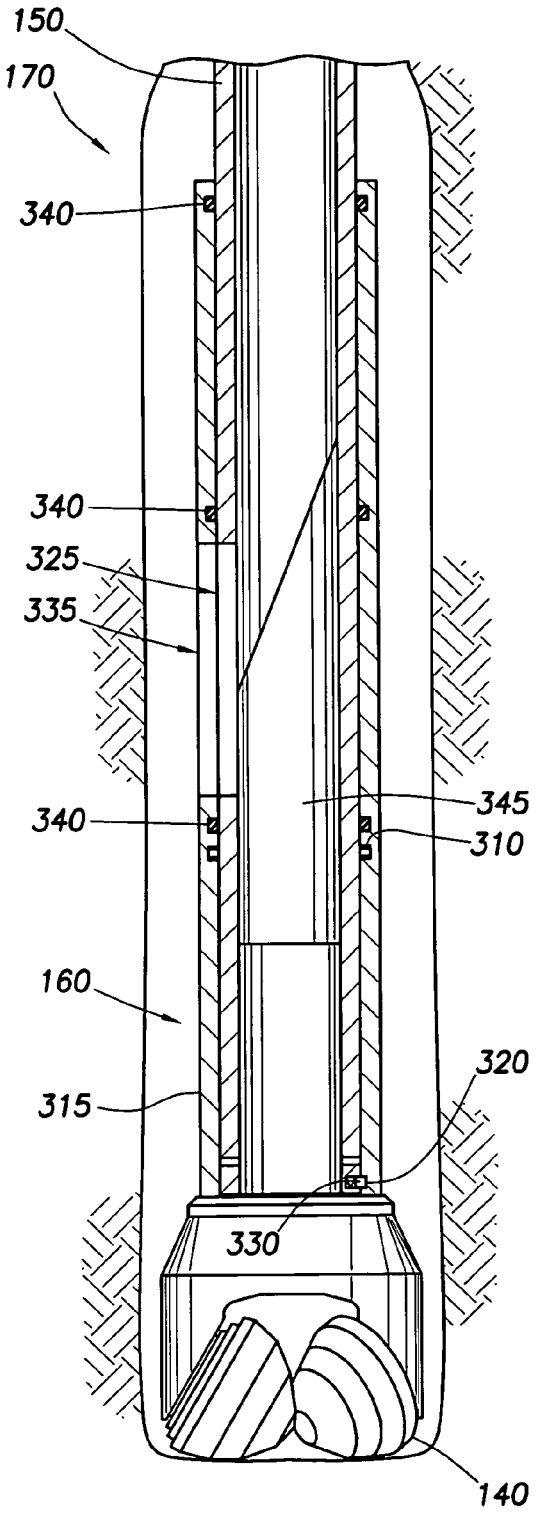
FIG. 6C is a cross-sectional view illustrating a diverter disposed adjacent the pre-milled windows.

FIG. 6C is a cross-sectional view illustrating a diverter 345 disposed adjacent the pre-milled windows 325, 335. The diverter 345 is typically disposed and secured in the string of casing 150 by a wireline assembly (not shown) or other means well known in the art. Generally, the diverter 345 is an inclined wedge placed in a wellbore 100 to force a drilling assembly (not shown) to start drilling in a direction away from the wellbore 100 axis. The diverter 345 must have hard steel surfaces so that the drilling assembly will preferentially drill through rock rather than the diverter 345 itself. In the embodiment shown, the diverter 345 is oriented to direct the drilling assembly outward through the pre-milled windows 325, 335.

Figure 6D:
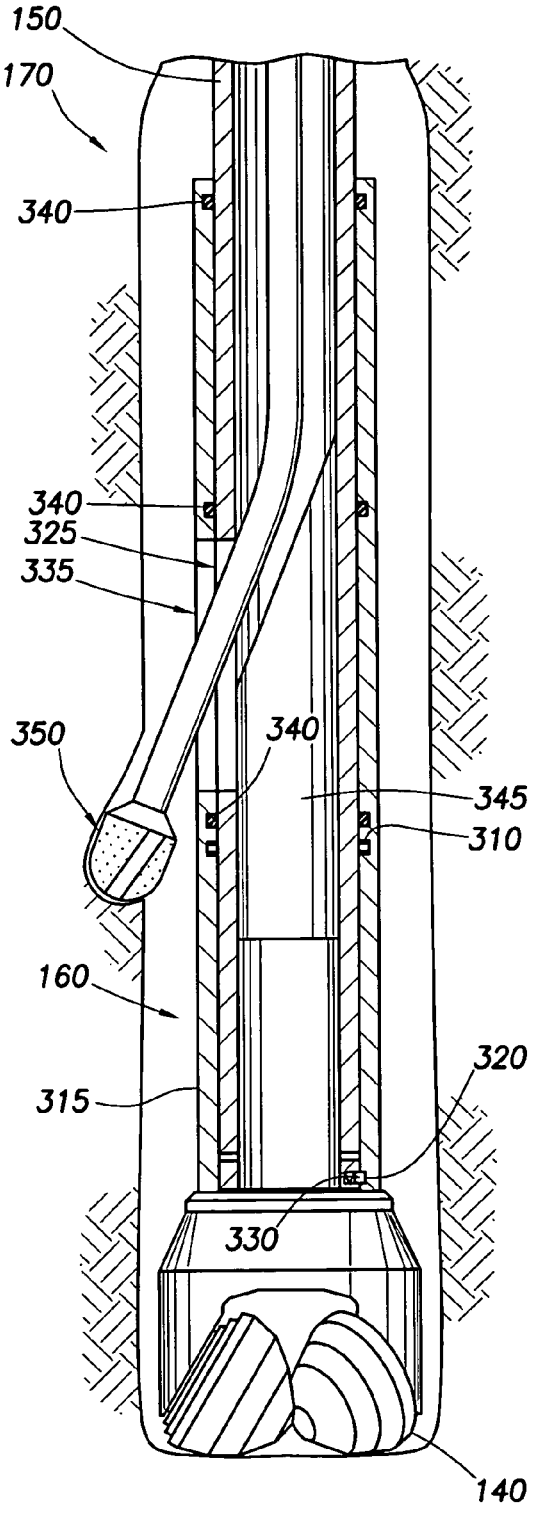
FIG. 6D is a cross-sectional view illustrating a drilling assembly diverted through the pre-milled windows.

FIG. 6D is a cross-sectional view illustrating a drilling assembly 350 diverted through the pre-milled windows 325, 335. As shown, the diverter 345 has directed the drilling assembly 350 through the pre-milled windows 325, 335 to form a lateral wellbore.

Figure 7A:
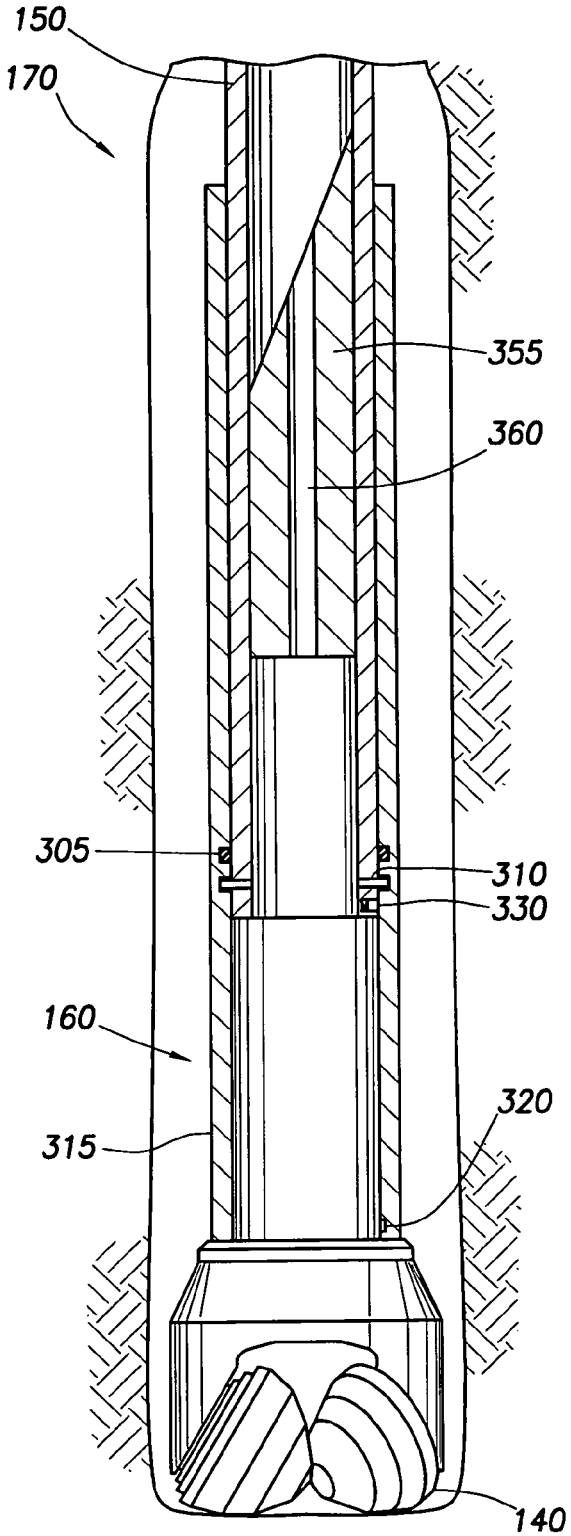
FIG. 7A is a cross-sectional view of an alternative embodiment illustrating a hollow diverter in the casing assembly.

FIG. 7A is a cross-sectional view of an alternative embodiment illustrating a hollow diverter 355 in the casing assembly 150. Prior to forming the wellbore 100 with the string of casing 150, the hollow diverter 355 is disposed in the string of casing 150 at a predetermined location. The hollow diverter 355 may be oriented in a particular direction if needed, or placed into the string of casing 150 blind, with no regard to the direction. In either case, the hollow diverter 355 functions in a similar manner as discussed in the previous paragraph. However, a unique aspect of the hollow diverter 355 is that it is constructed and arranged with a fluid bypass 360. The fluid bypass 360 permits drilling fluid that is pumped from the surface of the wellbore 100 to be communicated to the drill bit 140 during the drilling by casing operation. In other words, the installation of the hollow diverter 355 in the string of casing 150 prior to drilling the wellbore 100 will not block fluid communication between the surface of the wellbore 100 and the drill bit 140 during the drilling operation.

Figure 7B:
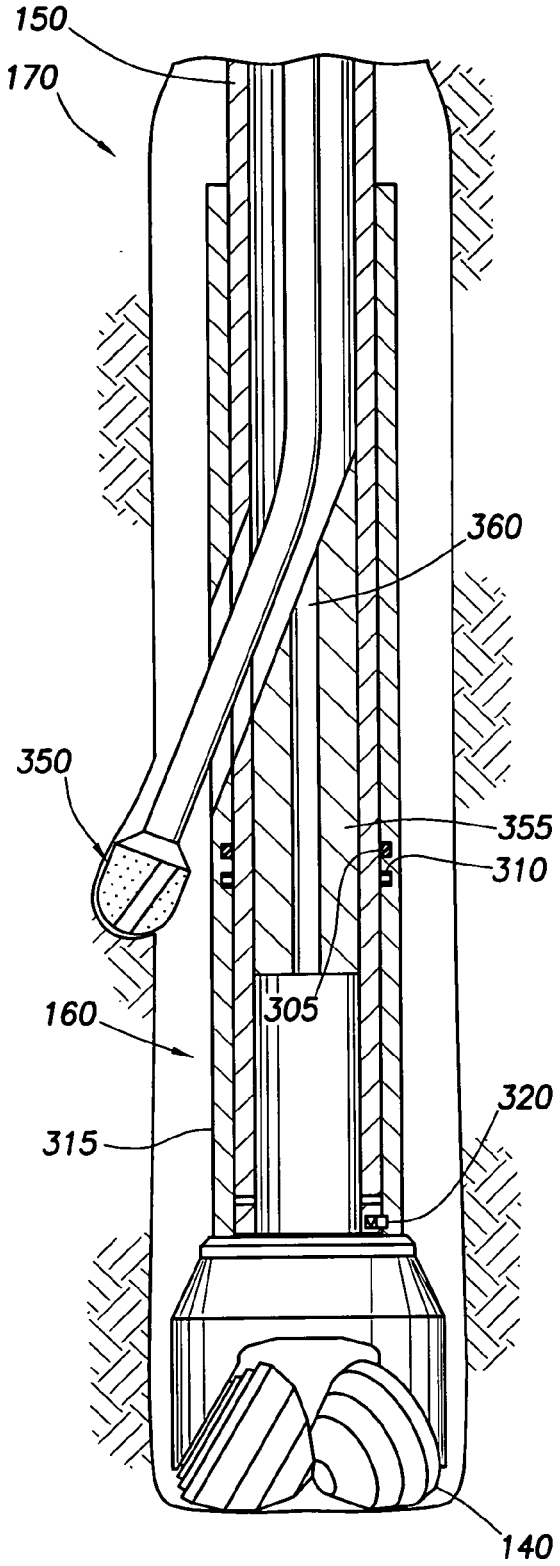
FIG. 7B is a cross-sectional view illustrating a lateral bore drilling operation.

FIG. 7B is a cross-sectional view illustrating a lateral bore drilling operation using the hollow diverter 355. As shown, the hollow diverter 355 has directed the drilling assembly 350 away from the wellbore 100 axis to form a lateral wellbore.

In operation, a casing assembly is attached to the end of a run-in string by a running tool and thereafter lowered through a riser system that interconnects a floating vessel and a subsea wellhead. The casing assembly is constructed from a casing mandrel, a string of casing and a collapsible apparatus. After the casing assembly enters the subsea wellhead, the casing assembly is rotated and urged axially downward to form a subsea wellbore.

Typically, a motor rotates the run-in string and subsequently the run-in string transmits the rotational torque to the casing assembly and a drill disposed at a lower end thereof. At the same time, the run-in string, the running tool, the casing assembly and drill bit are urged axially downward until a lower surface on the casing mandrel of the casing assembly is positioned at a predetermined height above an upper portion of the casing hanger. At this time, the rotation of the casing assembly is stopped. Thereafter, a mechanical or hydraulic axial force is applied to the casing assembly causing a locking mechanism in the collapsible apparatus to fail and allows the string of casing to move axially downward to reduce the overall length of the casing assembly permitting the casing mandrel to seat in the casing hanger. Additionally, the axial downward movement of the string of casing permits an inwardly biased torque key to engage a groove at the lower end of the tubular member to create a mechanical torque connection between the string of casing and the collapsible apparatus. Thereafter, the string of casing is cemented into the wellbore and the entire run-in string is removed from the wellbore.

While the foregoing is directed to embodiments of the present invention, other and further embodiments of the invention may be devised without departing from the basic scope thereof, and the scope thereof is determined by the claims that follow.

The invention claimed is:

1. A method of lining a subsea wellbore, comprising:

placing a string of casing with a shoe at the lower end thereof in a riser system;

urging the string of casing axially downward; and reducing the axial length of the string of casing through telescopic movement between a larger diameter portion and a smaller diameter portion of the string of casing to land a wellbore component in a subsea wellhead.

2. The method of claim 1, further including rotating the string of casing as the string of casing is urged axially downward.

3. The method of claim 2, wherein the wellbore component lands in the subsea wellhead without rotation of the wellbore component in the subsea wellhead.

4. The method of claim 1, wherein the wellbore component is a casing mandrel disposed at the upper end of the string of casing.

5. The method of claim 1, wherein reducing the axial length of the string of casing aligns pre-milled windows in the string of casing.

6. The method of claim 5, further including positioning a diverter adjacent the pre-milled windows.

7. The method of claim 6, wherein the diverter includes a flow bypass.

8. The method of claim 7, further including forming a lateral wellbore by diverting a drilling assembly through the pre-milled windows.

9. The method of claim 1, further including disposing a diverter in the string of casing at a predetermined location.

10. The method of claim 9, wherein the diverter includes a flow bypass.

11. The method of claim 10, further including diverting a drilling assembly away from an axis of the subsea wellbore to form a lateral wellbore.

12. The method of claim 1, wherein reducing the axial length of the string of casing displaces an outer drilling section of the shoe to allow the shoe to be drilled therethrough.

13. The method of claim 1, wherein reducing the axial length of the string of casing moves a sleeve in a float apparatus from a first position to a second position, thereby activating the float apparatus.

14. The method of claim 1, further including applying an axial force to the string of casing.

15. The method of claim 14, wherein the axial force is generated by a wireline apparatus disposed in the string of casing.

16. The method of claim 1, wherein the axial length of the string of casing is reduced by a collapsible apparatus disposed above the shoe.

17. The method of claim 16, wherein the collapsible apparatus includes a locking mechanism that is constructed and arranged to deactivate upon receipt of a signal from the surface.

18. The method of claim 16, wherein the collapsible apparatus includes a torque assembly for transmitting a rotational force from the string of casing to the shoe.

19. The method of claim 18, wherein the collapsible apparatus includes a locking mechanism that is constructed and arranged to fail at a predetermined axial force.

20. The method of claim 19, wherein the locking mechanism comprises a shear pin.

21. The method of claim 19, wherein the locking mechanism allows the collapsible apparatus to shift between a first and a second position.

22. The method of claim 21, wherein the collapsible apparatus in the second position reduces the axial length of the string of casing.

23. The method of claim 1, further comprising permitting a weight of the string of casing to compress a portion of the string of casing to reduce the axial length thereof.

24. A method of lining a subsea wellbore, comprising:

disposing a run-in string with a casing string at the lower end thereof in a riser system, the casing string having a casing mandrel disposed at an upper end thereof and a collapsible apparatus and a shoe disposed at a lower end thereof;

urging the casing string axially downward to a predetermined depth, whereby the casing mandrel is a predetermined height above a casing hanger; and reducing the length of the casing string thereby seating the casing mandrel in the casing hanger.

25. The method of claim 24, further including applying a downward axial force to the casing string.

26. The method of claim 24, wherein the length of the casing string is reduced by the collapsible apparatus disposed above the shoe.

27. The method of claim 26, wherein the collapsible apparatus includes at least one torque assembly for transmitting a rotational force from the string of casing to the shoe.

28. The method of claim 26, wherein the collapsible apparatus includes a locking mechanism that is constructed and arranged to fail at a predetermined axial force.

29. The method of claim 26, wherein the locking mechanism allows the collapsible apparatus to shift between a first and a second position, whereby in the second position the collapsible apparatus reduces the length of the casing string.

30. The method of claim 24, further including placing the casing string in compression.

31. The method of claim 24, further including cementing the casing string in the wellbore.

32. A method of landing a casing mandrel in a casing hanger disposed in a subsea wellhead, comprising:

placing a casing string with the casing mandrel disposed at the upper end thereof into a riser system;

lowering the casing string into the subsea wellhead;

positioning the casing mandrel at a height above the casing hanger; and reducing the axial length of the casing string through sliding movement between a larger diameter portion and a smaller diameter portion of the string of casing to seat the casing mandrel in the casing hanger.

33. The method of claim 32, wherein a collapsible apparatus disposed above a shoe reduces the axial length of the casing string.

34. The method of claim 33, wherein the collapsible apparatus includes a locking mechanism that is constructed and arranged to fail at a predetermined axial force.

35. The method of claim 34, further including applying a downward axial force to the casing string causing the locking mechanism to fail.

36. The method of claim 32, further including permitting a weight of the string of casing to compress a portion of the string of casing to reduce the axial length thereof of the casing string.

* * * * *